United States Patent [19]

Lin

[11] Patent Number: 4,637,589

[45] Date of Patent: Jan. 20, 1987

[54] BI-SECTION ADJUSTABLE CONNECTOR BRIDGING AN OPENED HANDRAIL

[76] Inventor: Ta C. Lin, 8, Lane 4, Pei Jung Street, Chiayi City, Taiwan

[21] Appl. No.: 734,703

[22] Filed: May 16, 1985

[51] Int. Cl.[4] ..... E04H 17/14

[52] U.S. Cl. ..... 256/59; 256/1; 403/8; 403/296

[58] Field of Search ..... 403/8, 296, 86; 256/59, 256/65, 67, 1; 411/389

[56] References Cited

U.S. PATENT DOCUMENTS

| | | | |
|---|---|---|---|
| 167,118 | 8/1875 | Pritchett | 403/8 |
| 4,044,511 | 8/1977 | Lingle | 403/8 X |
| 4,557,467 | 12/1985 | Lin | 256/1 |

FOREIGN PATENT DOCUMENTS

| | | | |
|---|---|---|---|
| 2632696 | 1/1978 | Fed. Rep. of Germany | 403/296 |
| 581942 | 10/1924 | France | 403/8 |
| 21412 | of 1900 | United Kingdom | 411/389 |

*Primary Examiner*—Andrew V. Kundrat
*Attorney, Agent, or Firm*—Browdy and Neimark

[57] ABSTRACT

The present invention is a bi-section adjustable connector used to bridge two segments of an opened handrail at a turning place.

The device consists of two L-shaped component bars. During installation the two component bars are joined end to end by one or two sets of a nut and washer mounted on a bolt having one or both ends threaded. Each half of the bolt is placed in an individual horizontal hole in each component bar.

Before tightening up the nuts and washers on the extended portions of the bolt, the assembled bars can be adjusted properly by pivoting along the bolt to align other ends with the ends of the opened handrail at the turning place.

Following the tightening up of the nuts, the smooth connection is completed by fixing those ends together.

4 Claims, 4 Drawing Figures

FIG 2-A
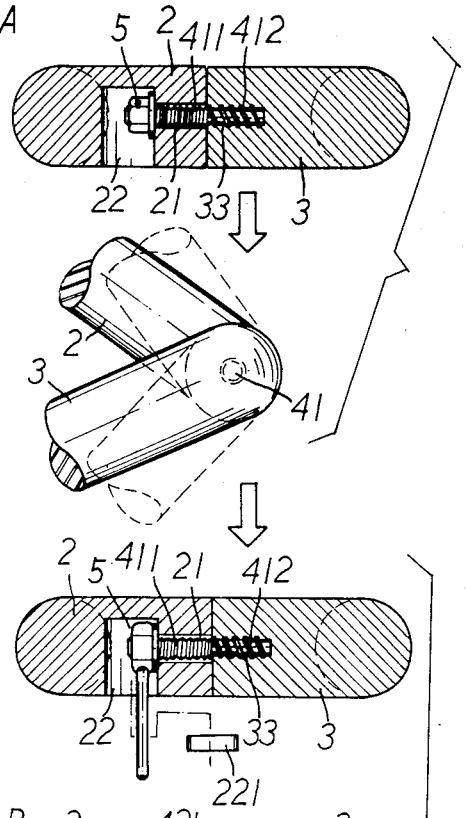
FIG2-B
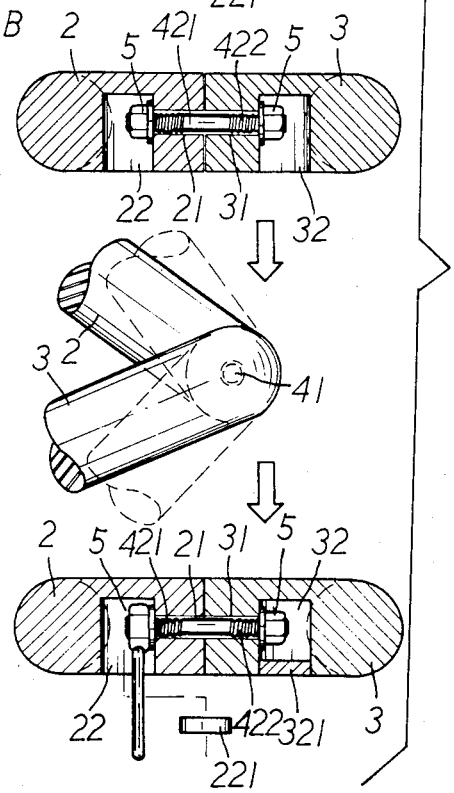

BI-SECTION ADJUSTABLE CONNECTOR BRIDGING AN OPENED HANDRAIL

BACKGROUND OF THE INVENTION

The subject matter relates to a device which can serve as a bridge between an opened handrail at a turning place. Carrying out the connection in a conventional manner, either by inserting an N-shaped connector or by putting a roughly shaped block of wood, which must be modified gradually, into the opened handrail, some measuring, calculating, and labor have to be carefully done to ensure a successful connection. This process often results in imperfect connection.

The inventor, working in this field for tens of years, has devoted his time to providing a device which can be produced in mass quantity, and enjoy much freedom of adjusting in its installation, as well as reduce the chance of failure of the installation to minimum.

SUMMARY OF THE INVENTION

In actual practice, the component bars are first jointed end to end by a set including a bolt, nut and washer. Each half of the bolt is located in a horizontal hole in the component bar, and the nuts and washers are mounted on the extended portions of the bolt protruding beyond the holes.

Adjusting the two assembled component bars relatively makes the free ends of the bars align with the ends of the opened handrail in a smooth manner, then the two jointed bars are locked together by tightening up the nuts and washers. In the final step, the free ends of the bars are fixed to each corresponding end of the opened handrail to complete the whole connection.

A vertical hole is drilled on each component bar for placing in the nut and washer for the joining of the two component bars. The holes can be covered with a piece of round lid after the connection to make the assembly of the bars unnoticed.

Other objects, features and advantages will become more readily apparent from the following description and the accompanying sheets of illustration.

DESCRIPTION OF DRAWINGS

FIG. 2A and FIG. 2B are illustrations of two types of component bars jointed together in two different cases.

DETAILED DESCRIPTION

Figure 1:
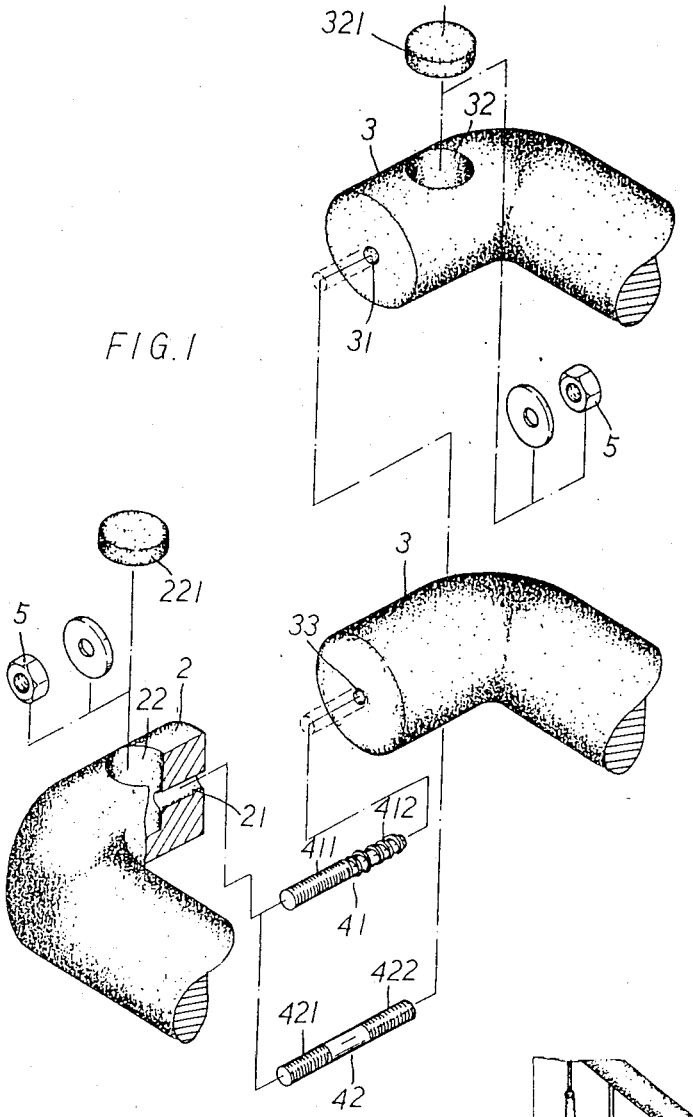
FIG. 1 is a perspective view of two corresponding L-shaped component bars with two types of it drawn.

Referring to FIG. 1, the said subject matter is made up of a pair of smoothly-bent component bars of "L" shape, i.e., the upper bar 2 and the lower bar 3, in which vertical holes 22, 32, horizontal holes 21, 31 or 33 are drilled for the location of bolts 41 or 42, nuts 5 and washers. In actual practice, the ends of the component bars are joined together first by means of the said bolts, nuts, and washers.

Two types of bolts 41, 42 are used by each corresponding component bar. Bolt 41 is threaded on one end 411, but spirally threaded on the other end 412 which is screwed into a horizontal hole 33 drilled in lower bar 3 with its size just a bit smaller than the diameter of bolt 41 to ensure a tight link; the remaining end located in hole 21 of upper bar 2, with a portion of it protruding beyond hole 21, a set of wsher and nut 5 is put in through hole 22 respectively, and mounted on the end 411 and lock the two bars together.

The type of bolt 42 is equally threaded on both ends 421, 422, which are protruding beyond the holes 21, 31 in the component bars where the two sets of nut and washer 5 are seated to lock the component bars together.

Before tightening up the nuts, the free ends of the joined component bars are guided in agreement with the ends of an opened handrail by adjusting them relative to each other, referring to FIGS. 2A and 2B, then the connection is completed by tightening up the nuts and putting the round lids 221, 321 in the top of the holes 22, 32 to cover the joint.

Figure 3:
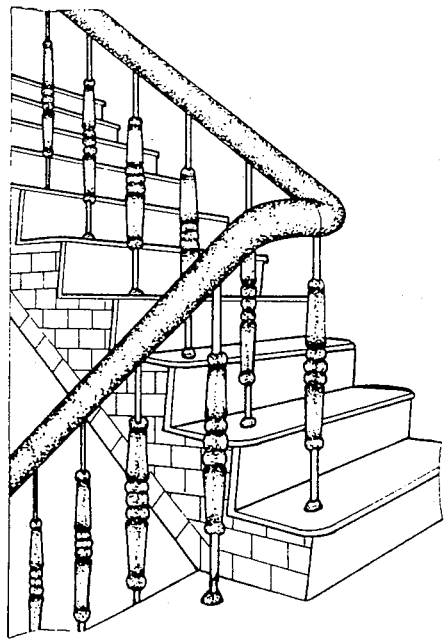
FIG. 3 is an accomplished application of the two component bars to a handrail.

As shown in FIGS. 2A and 2B, component bars 2 and 3 are rotated about bolt 41 or 42, respectively, until component bars 2 and 3 are oriented at the desired relative angular orientation. Once this desired orientation has been reached, nut 5 may be tightened through hole 22, 32 to fix component bar 2 and 3 in this orientation FIG. 3 shows component bars 2 and 3, in the desired orientation relative to each other, with a finished stairway railing.

The obvious merits of using this said device are its ease of installation and the almost unnoticed assembly as well as the great freedom of adjusting to different connecting situations.

It is to be understood, however, that even though there is herein shown and described a preferred embodiment of the invention, the same is susceptible to certain changes fully comprehended by the spirit of the invention as herein described and the scope of the appended claims.

I claim:

1. A device for joining two L-shaped component bars for a stairway railing, comprising:

a first and a second L-shaped component bar, both said first and second component bars defining a horizontally extending opening at one end thereof, and said first component bar also defining a vertically extending opening extending radially from the exterior of said first bar and intersecting said horizontally extending opening in said first component bar;

a bolt means having two ends and threaded at least one end thereof for insertion of said bolt ends within said horizontally extending openings of both said first and second component bars and thereby joining said first and second component bars, said threaded end terminating within said vertically extending opening, and being of a smaller diameter than said horizontally extending opening in said first bar;

a nut means fitting within said vertically extending opening for screwing onto said threaded end of said bolt means to thereby tighten said joining;

lid means for plugging the exterior of said vertically extending opening.

2. The device of claim 1, wherein said other end of said bolt is threaded and of a smaller diameter than said horizontally extending opening in said second bar, and said second component bar defines a second vertically extending opening radially from the exterior of said second bar and intersecting said horizontally extending opening in said second bar, said threaded other end terminating within said second vertically extending opening.

3. The device of claim 1, wherein said other end of said bolt is spirally threaded and is screwed into said horizontally extending opening in said second bar, said other end of said bolt being slightly larger in diameter than said horizontally extending opening in said second bar.

4. A method for joining two L-shaped component bars of a stairway railing, comprising:

inserting a threaded end of a bolt means having two ends within a horizontally extending opening at one end of a first L-shaped component bar, the inserted end of said bolt means having a diameter smaller than said horizontally extending opening;

inserting the other end of said bolt means into a horizontally extending opening in one end of a second L-shaped component bar;

inserting a nut means through a vertically extending opening extending radially from the exterior of said first component bar and intersecting with said horizontally extending opening of said first component bar;

screwing said nut means onto said threaded end of said bar so that said threaded end terminates within said vertically extending opening;

adjusting the angular orientation of said first and second component bars relative to each other by rotation about said bolt;

tightening said nut means on said threaded end of said bolt through said vertically extending opening to maintain said first and second component bars in said adjusted angular orientation;

plugging the exterior of said vertically extending opening.

* * * * *